US010655336B2

(12) United States Patent
Friel

(10) Patent No.: US 10,655,336 B2
(45) Date of Patent: May 19, 2020

(54) WEEP SCREED

(71) Applicant: Alabama Metal Industries Corporation, Birmingham, AL (US)

(72) Inventor: Denis P. Friel, Havertown, PA (US)

(73) Assignee: ALABAMA METALS INDUSTRIES CORPORATION

( * ) Notice: Subject to any disclaimer, the term of this patent is extended or adjusted under 35 U.S.C. 154(b) by 0 days.

(21) Appl. No.: 16/011,740

(22) Filed: Jun. 19, 2018

(65) Prior Publication Data

US 2019/0136543 A1 May 9, 2019

Related U.S. Application Data

(63) Continuation of application No. 15/446,732, filed on Mar. 1, 2017, now Pat. No. 10,024,063.

(60) Provisional application No. 62/301,854, filed on Mar. 1, 2016.

(51) Int. Cl.

| | |
|---|---|
| ***E04F 13/06*** | (2006.01) |
| ***E04B 1/76*** | (2006.01) |
| ***E04B 1/70*** | (2006.01) |
| ***E04F 19/02*** | (2006.01) |

(52) U.S. Cl.

CPC ..... *E04F 13/06* (2013.01); *E04B 1/70* (2013.01); *E04B 1/765* (2013.01); *E04F 19/02* (2013.01)

(58) Field of Classification Search

CPC ..... E04B 1/70; E04F 13/06
USPC ..... 52/302.1
See application file for complete search history.

(56) References Cited

U.S. PATENT DOCUMENTS

| | | | | |
|---|---|---|---|---|
| 2,645,824 | A | 7/1953 | Titsworth | |
| 3,206,806 | A * | 9/1965 | Powell | E04F 19/064 52/241 |
| 3,343,323 | A * | 9/1967 | Mayfield | E04B 1/7076 454/254 |
| 3,568,391 | A * | 3/1971 | Conway | E04B 1/7023 52/586.2 |
| 4,924,647 | A | 5/1990 | Drucker | |
| 5,630,297 | A | 5/1997 | Rutherford | |
| 5,694,723 | A | 12/1997 | Parker | |

(Continued)

FOREIGN PATENT DOCUMENTS

| | | |
|---|---|---|
| AU | 2008202082 A1 | 11/2008 |
| CA | 2777166 A1 | 11/2012 |

(Continued)

OTHER PUBLICATIONS

From U.S. Appl. No. 15/446,732—cited as "Prior Art Weep Screed from Google Search 1 page dated 2004".

(Continued)

*Primary Examiner* — Paola Agudelo
(74) *Attorney, Agent, or Firm* — Jennifer Meredith, Esq.; Lippes Mathias Wexler Friedman, LLP

(57) ABSTRACT

A weep screed having an elongate substantially planar back flange and an elongate upper flange extending outwardly from an outward side of the back. Apertures formed in the upper flange allow water to drain. An elongate bottom flange section extends outwardly from the back flange below the upper flange and has an upper member extending outwardly and downwardly from said back flange and an outer edge spaced from the back flange. Also provided is a method of applying a veneer finish using the weep screed.

18 Claims, 11 Drawing Sheets

(56) References Cited

U.S. PATENT DOCUMENTS

| | | | | |
|---|---|---|---|---|
| 5,809,731 | A | 9/1998 | Reiss | |
| 5,836,135 | A * | 11/1998 | Hagan | E04B 1/762 52/836 |
| 6,018,924 | A * | 2/2000 | Tamlyn | E04F 19/02 52/287.1 |
| 6,119,429 | A | 9/2000 | Bifano | |
| 6,293,064 | B1 | 9/2001 | Larson | |
| 6,298,609 | B1 | 10/2001 | Bifano | |
| 6,308,470 | B1 | 10/2001 | Durkovic | |
| 6,385,932 | B1 | 5/2002 | Melchiori | |
| 6,410,118 | B1 * | 6/2002 | Reicherts | B32B 13/04 428/141 |
| 6,470,638 | B1 * | 10/2002 | Larson | E04B 1/765 52/254 |
| 6,792,725 | B1 | 9/2004 | Rutherford | |
| 6,823,633 | B2 | 11/2004 | Ryan | |
| 7,219,477 | B2 * | 5/2007 | Leffler | E04F 13/00 52/277 |
| 7,546,719 | B1 * | 6/2009 | Guevara | E04F 13/06 52/302.6 |
| 7,584,587 | B2 * | 9/2009 | Ouellette | E04F 13/0889 33/646 |
| 7,621,079 | B2 | 11/2009 | Kyozaburo | |
| 7,743,575 | B2 * | 6/2010 | Ito | E04F 13/0889 52/461 |
| 7,810,291 | B2 | 10/2010 | McPherson | |
| 8,281,530 | B2 * | 10/2012 | Chaussee | E04F 13/0803 52/290 |
| 8,578,660 | B2 * | 11/2013 | Nolan | E04F 19/045 52/302.6 |
| 8,596,019 | B2 * | 12/2013 | Aitken | E04B 2/82 52/710 |
| 8,646,222 | B2 | 2/2014 | Carbonaro | |
| D700,717 | S * | 3/2014 | Campacci | D25/119 |
| 8,726,594 | B2 | 5/2014 | Salazar | |
| 8,813,443 | B2 | 8/2014 | Goldberg | |
| 8,919,062 | B1 | 12/2014 | Viness | |
| 8,943,761 | B2 | 2/2015 | Carbonaro | |
| 9,140,008 | B2 | 9/2015 | Fischer | |
| 9,366,040 | B2 * | 6/2016 | Singh | E04F 19/065 |
| 2003/0126810 | A1 | 7/2003 | Brunson | |
| 2003/0177736 | A1 * | 9/2003 | Gatherum | E04B 1/70 52/741.1 |
| 2006/0123723 | A1 | 6/2006 | Weir | |
| 2006/0277854 | A1 * | 12/2006 | Egan | E04B 1/70 52/302.3 |
| 2007/0044402 | A1 | 3/2007 | Hess | |
| 2009/0183453 | A1 * | 7/2009 | Koessler | E04F 13/007 52/302.3 |
| 2010/0101168 | A1 | 4/2010 | Hohmann | |
| 2010/0287861 | A1 | 11/2010 | Goldberg | |
| 2011/0252731 | A1 | 10/2011 | Boyer | |
| 2011/0302863 | A1 * | 12/2011 | Sourlis | E02D 19/00 52/302.1 |
| 2012/0066984 | A1 * | 3/2012 | Thompson | E04D 1/18 52/11 |
| 2012/0066986 | A1 | 3/2012 | Thompson | |
| 2013/0125487 | A1 | 5/2013 | Power | |
| 2015/0013257 | A1 | 1/2015 | Power | |
| 2015/0027074 | A1 | 1/2015 | Preston | |
| 2017/0030072 | A1 | 2/2017 | Corson | |
| 2017/0226732 | A1 | 8/2017 | Collins | |
| 2017/0254091 | A1 | 9/2017 | Friel | |

FOREIGN PATENT DOCUMENTS

| | | | |
|---|---|---|---|
| JP | 2657037 | B2 | 9/1997 |
| JP | 10037321 | | 2/1998 |
| JP | 11131611 | A | 5/1999 |
| JP | 2008196248 | | 8/2008 |
| JP | 4490340 | B2 | 6/2010 |
| JP | 5968618 | | 8/2010 |
| JP | 2011169094 | A | 9/2011 |
| JP | 5002275 | | 8/2012 |
| JP | 2012202177 | | 10/2012 |
| JP | 2014218814 | | 11/2014 |
| WO | WO2016040273 | | 3/2016 |

OTHER PUBLICATIONS

From U.S. Appl. No. 15/446,732—cited as "Images of J-Bead believed to have been known in the art prior to Mar. 1, 2016".

* cited by examiner

WEEP SCREED

CROSS REFERENCE TO RELATED APPLICATION

This application claims the benefit of U.S. provisional patent application Ser. No. 62/301,854 filed on Mar. 1, 2016, and which is incorporated herein by reference in its entirety.

BACKGROUND OF THE INVENTION

Field of the Invention

The present subject matter relates to weep screeds that facilitate the application of veneer building materials such as stucco, stone, and brick on external walls.

RELATED ART

In one form of construction, stucco veneer, brick veneer, stone veneer and other such external veneer building materials are used as an exterior finished wall material for residential and commercial buildings. These materials allow architects to provide a variety of different low maintenance designs and wall textures.

A weep screed is a building device used with veneer building finishes. It is used where the veneer material terminates. In one application, the weep screed is attached along the base of the exterior wall where the wall meets the top of the building foundation, e.g., the weep screed is placed strategically to overlap the joint between the exterior framed wall and the foundation. This prevents water, e.g., rain and sprinkler water, from entering between the external wall and the foundation. Such devices are also used to support the end of the veneer structure and to provide a means for moisture to escape from behind the veneer finish.

Current methods for applying outer veneer finishes use layers of various building materials. For example, for a stucco veneer application on a plywood sheathing outer wall, a weep screed is attached overlapping the boundary between the foundation and the outer wall supported on the foundation. The plywood sheathing is then covered with a weather barrier material such as Tyvek®, which extends onto and terminates in the weep screed. Over the weather barrier is provided a drainage mat, such as Driwall™ Rainscreen, which is a permeable mat-like material that allows water to drain through it. Over the drainage mat is provided a mesh, such as a wire lath, which acts as a support frame for holding the plaster in place, and which stabilizes the first coat of wet plaster when initially applied. The first coat of wet plaster, e.g., the scratch coat, is applied onto the mesh. The second or brown coat of plaster is applied over the first coat of plaster, and the final finish or stucco coat is applied onto the second coat to finish the stucco veneer system. The various layers discussed above terminate at the weep screed.

One potential issue with such materials is the possibility of moisture and water getting behind the finished wall veneer material. For example, stucco, a plaster material, and brick and stone veneer, which use cementuous materials, are porous and may absorb water and water vapor into the building layers beneath the exterior stucco surface (the term plaster as used herein includes plaster and cementuous like materials used in such veneers). Water vapor can also condense behind the exterior veneer surface. Furthermore, poor construction techniques, particularly around windows where waterproofing may be applied improperly allow rain-water to get behind the exterior veneer wall. The water will drain down the inside of the veneer structure between the various construction layers, particularly through the drainage mat if used. If not collected and removed properly, this water can damage the finished veneer material. For example, if water within or along the veneer finish freezes, it can cause the veneer to crack and pieces to break off.

One problem with prior art weep screeds is that they do not effectively facilitate drainage of the water from behind the veneer structure. One type of weep screed, as shown in U.S. Pat. No. 5,630,297 to Rutherford, shields the boundary between the building foundation and the external wall from water, but provides little support for the veneer and little water management for water draining through a drainage mat. In some cases, a second device, e.g., a J-bead, is added in addition to the weep screed for support and water management, but this requires a second piece and added costs associated therewith.

Other types of weep screeds include a series of small holes through the flange on which the veneer layers terminate. See, e.g., U.S. Pat. No. 6,385,932 to Melchiori. The holes, however, are typically located away from the back flange of the weep screed such that they sit below the plaster layer of the veneer and not the drainage mat layer. Moreover, because of their position and size, these holes may become plugged with plaster and not drain water effectively. The water may be retained behind and or under the veneer, or flow under the lower end of the veneer towards the edge of the weep screed. All of this can cause the veneer finish to crack and break over time, particularly when the water freezes.

Accordingly, an improved weep screed and an improved means for installing such veneer building finishes would prove beneficial.

SUMMARY OF THE SPECIFICATION

The present invention provides an improved weep screed for use in wall veneer applications. In one form, and in broad terms, the present invention provides a weep screed that includes an elongate substantially planar back flange having an outward side and an opposite inward side, and which back flange further has a top edge and a lower edge. Extending outwardly from the outward side of the back flange spaced from said top edge is an elongate upper flange. An elongate front flange extends upwardly from the upper flange and is spaced from the back flange. At least one channel is formed between the front flange and the back flange on the upper flange. The upper flange has a plurality of apertures through which water can drain. The apertures are spaced from one another and positioned adjacent to the back flange. Extending outwardly from the back flange below the upper flange is an elongate bottom flange section which has an upper member extending outwardly and downwardly from the back flange and further includes an outer edge spaced from the back flange.

In one embodiment, the apertures are positioned in the weep screed to be directly below the drainage mat to allow water to drain from the drainage mat and out the weep screed without passing under the lower edge of the plaster.

In another embodiment, the upper flange is divided into at least two sections, one for the weather barrier and drainage mat, the other for the mesh and plaster. This helps keep the water from the drainage mat away from the plaster.

Another embodiment of the present invention is directed to a method of applying a veneer finish using the improved weep screed.

BRIEF DESCRIPTION OF THE DRAWINGS

The following detailed description will be better understood when read in conjunction with the figures appended hereto. For illustrating the invention, there is shown in the drawings preferred embodiments of the present invention. It is understood, however, that this invention is not limited to these embodiments or the precise arrangements shown.

DETAILED DESCRIPTION

With initial reference to FIGS. 1 through 6, a weep screed 10 in accordance with a preferred embodiment of the present invention is now described. This embodiment is preferred for stucco veneer applications although it is useable for other veneer exterior finish applications as well.

Figure 1:
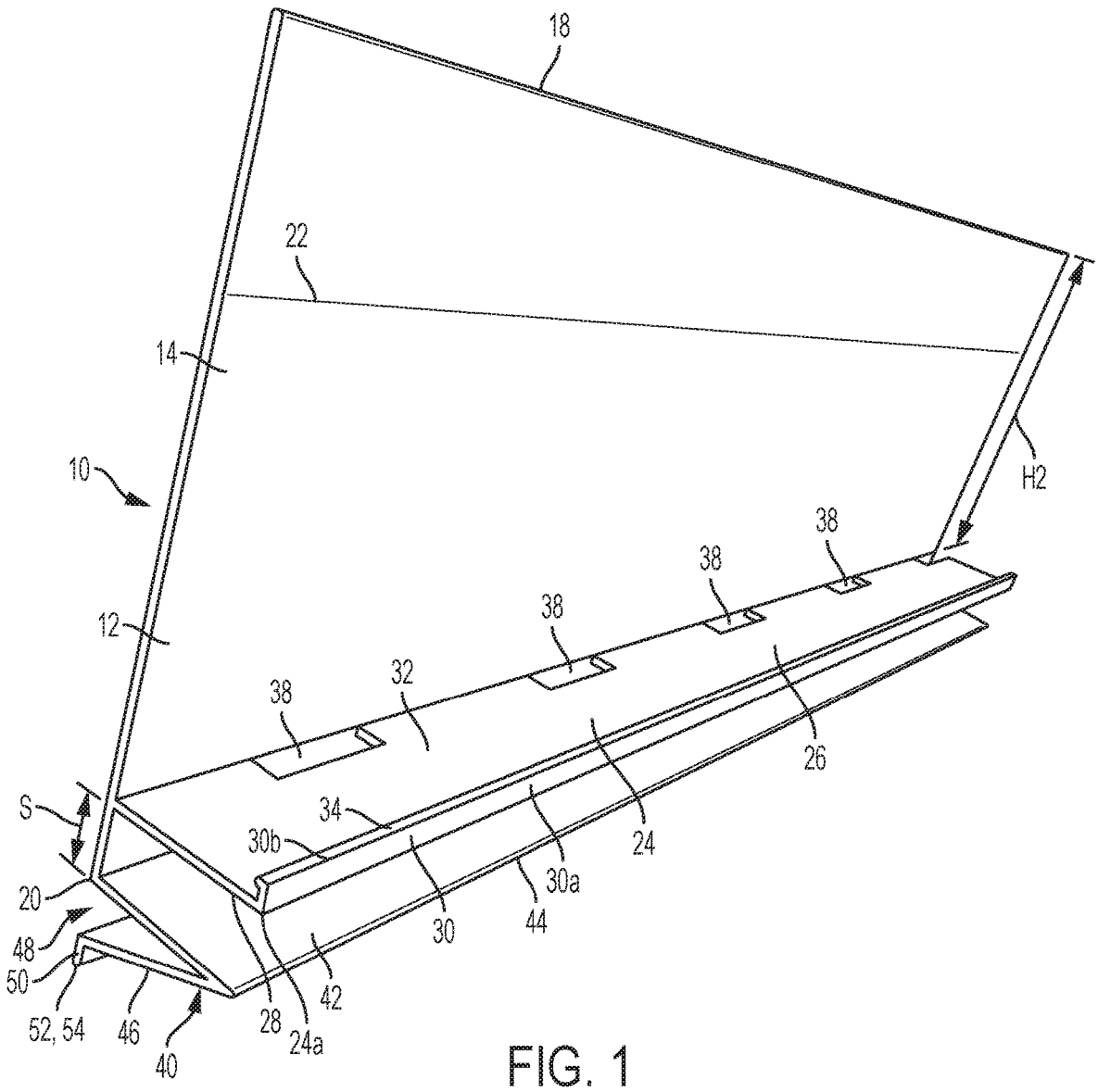
FIG. 1 is a perspective view of the weep screed in accordance with the present invention.
Figure 2:
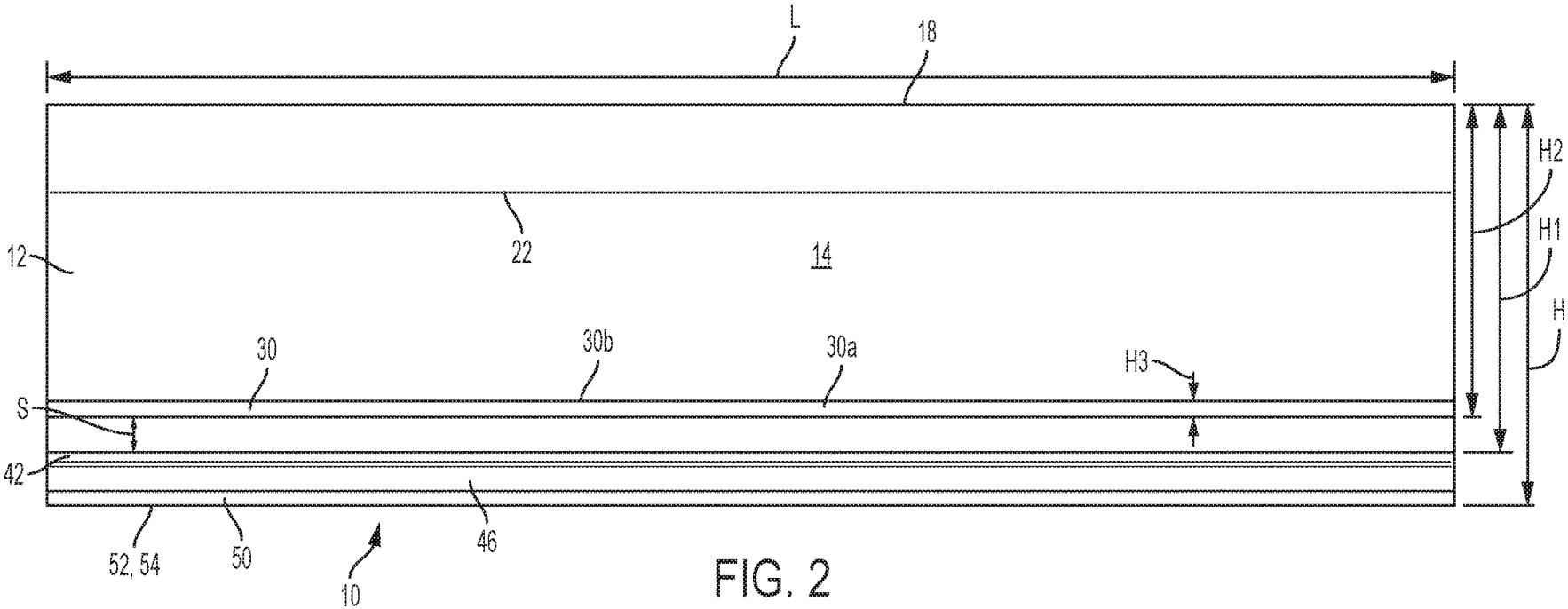
FIG. 2 is a front view of the weep screed shown in FIG. 1.
Figure 3:
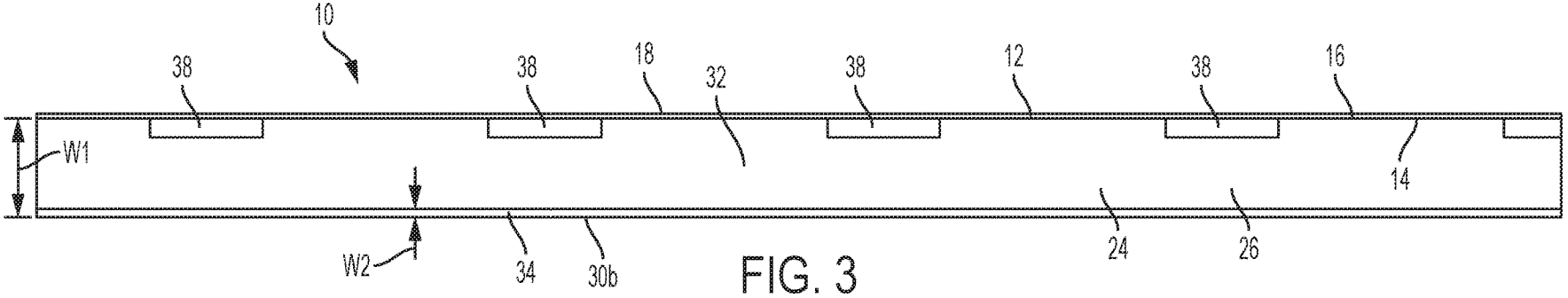
FIG. 3 is a top view of the weep screed shown in FIG. 1.
Figure 4:
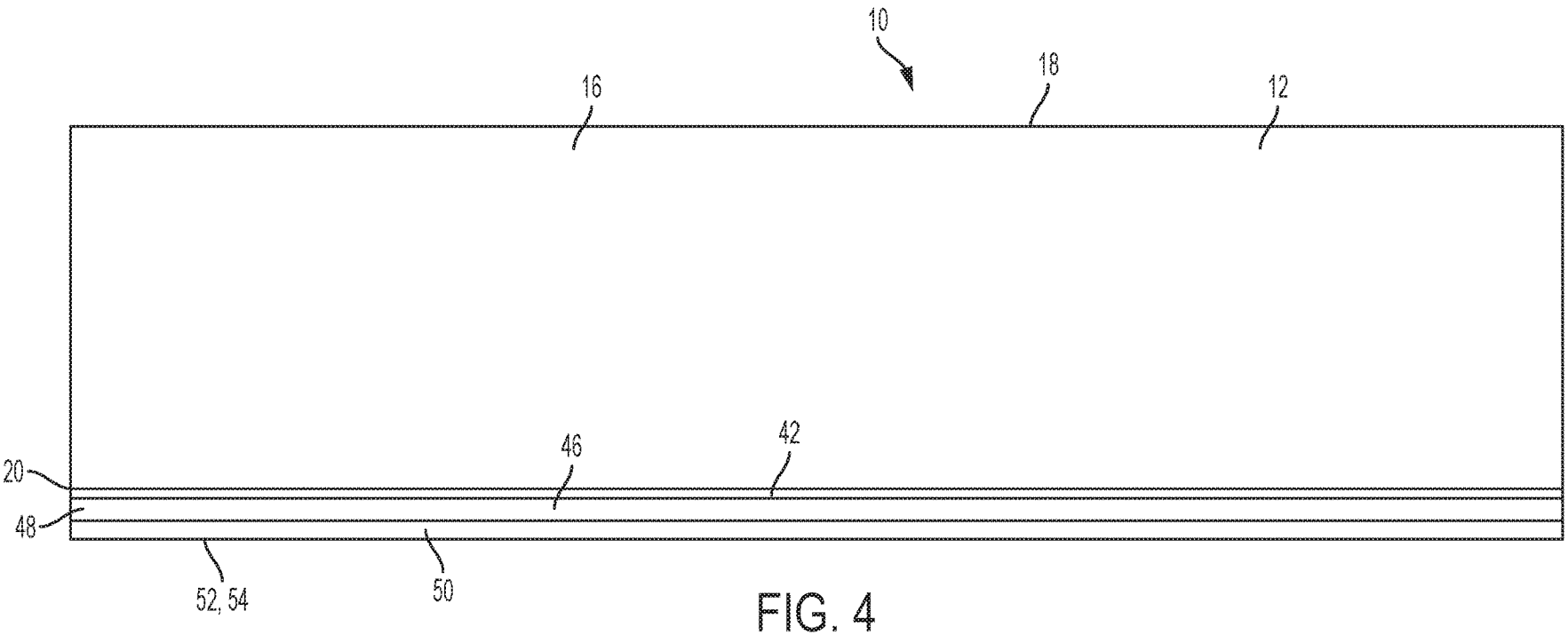
FIG. 4 is a back view of the weep screed shown in FIG. 1.
Figure 5:
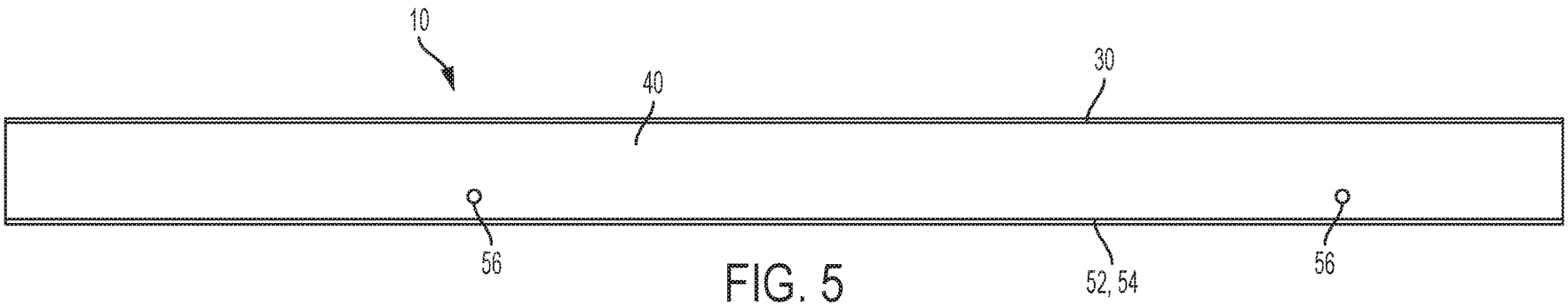
FIG. 5 is a bottom view of the weep screed shown in FIG. 1.

The weep screed 10 forms generally an elongate construction article that has a vertical height H and extends longitudinally a horizontal length L of any desired lengths as preferred in the construction industry (see FIG. 2). Regardless of its initial length L, the weep screed 10 can be cut to the desired length L for the particular application. For orientation purposes in describing the illustrated embodiments, and without limiting the invention, the term "inward" means a direction facing or extending towards the building wall to which the weep screed 10 is attached (leftward in FIGS. 1, 6 and 7); the term "outward" means a direction opposite of "inward" or facing or extending away from the building wall to which the weep screed 10 is attached (rightward in FIGS. 1, 6 and 7). The term "upward" means a direction facing or extending upwards in FIGS. 1, 6 and 7; the term "downward" means a direction opposite of "upward" or facing or extending downward in FIGS. 1, 6 and 7. The terms "horizontal" and "vertical" have their ordinary and customary meaning, e.g., the term "horizontal" means extending in the same direction as the length L in FIG. 2, and "vertical" means at right angles to the horizontal, which includes the direction of the height H.

Returning to FIGS. 1 through 6, the weep screed 10 includes an elongate substantially planar vertical back flange 12, which has an outward facing side 14 and an opposite inward facing side 16 (FIG. 3). The back flange 12 has a top edge 18, which in the illustrated embodiment, also defines the top edge of the weep screed 10. The back flange further has a lower edge 20, which in the illustrated embodiment, does not define the bottom edge of the weep screed 10. A nail line 22 may be provided as a guide for the application of nails or other attachment means, and can be provided in any suitable form, including a score formed in the material of the back flange 12 as shown, or by print.

Extending outwardly from the outward side 14 of the back flange 12 at a substantially right angle thereto is an elongate upper flange 24. The upper flange has an upper side 26 and an opposite lower side 28. As seen, the upper flange 14 is attached to and extends outwardly from the back flange 12 at a position spaced from the top edge 18 to provide sufficient height to receive the various building materials which terminate at or above the upper flange (see FIGS. 6 and 7).

An elongate front flange 30 extends upwardly from the upper flange 24 at a substantially right angle thereto spaced from the back flange. In the illustrated embodiment, the front flange 30 extends from the outward edge 24*a* of the upper flange 24, forming a sideways J-like structure as shown. As seen, the upper flange 24 forms a channel 32 between the back flange 12 and front flange 30. The width of the channel W1 (FIG. 3), i.e., the distance from the back flange 12 to the front flange 30, is chosen for receiving the various construction layers therewithin as further described below and can be sized for the specific use. The front flange 30 defines a substantially flat and vertical outward facing side 30*a* and further has an upper edge 30*b* which, in the illustrated embodiment, includes a lip 34 extending a short distance inwardly as shown.

A plurality of apertures 38 are provided in the upper flange 24 through which water can drain. The apertures 38 are preferably spaced from one another and disposed adjacent the back flange 12, preferably immediately adjacent to the back flange, i.e., directly along the back flange, or very close thereto. As discussed below, it is preferable to locate the apertures 38 directly below the drainage mat used in the veneer system to allow water draining through the drainage mat to drain and exit the apertures 38. The apertures 38 can take any suitable form and size, including round and elongated openings, and in one preferable form, are rectangular shaped openings disposed immediately adjacent the back flange 12 as shown.

It is believed that the placement and configuration of the apertures 38 is important for ensuring proper water drainage and management. The apertures 38 should be located to cooperate with the drainage mat that will terminate and sit within the upper flange 24 of the weep screed 10 through which the water drains from the veneer system. Thus, the apertures 38 should preferably be positioned to be directly below the drainage mat, and of a suitable size and configuration to handle satisfactorily the water without plugging due to dirt and other potential obstacles. In prior art weep screeds, apertures, when provided, tend to be small round holes located so as not to be below the drainage mat, but in many cases are positioned below the plaster layers, thereby interfering with the water drainage. The rectangular configuration shown for the plurality of apertures 38 in FIG. 1, about 1 inch length by 3/16 inch width, spaced from one another by about 3 inches from center to center of each aperture, and each located immediately adjacent the back flange 12 or otherwise to be directly below the drainage mat, is a currently preferred configuration for current veneer systems as further described below. Round apertures of about ⅜ inches diameter spaced about 2 inches apart diameter to diameter positioned immediately adjacent the back flange 12, or otherwise to be directly below the rain screen is also believed suitable, although other configurations and distances between openings can be used. With current construction, the spacing of the apertures 38 from the back flange 12 to the closest edge of the apertures 38 is preferably no greater than about ¼ inch (about ¼ inch or less), and in another form no greater than about 3/16 inch (about 3/16 inch or less), and in yet another form no greater than about 1/16 inch (about 1/16 inch or less), all ranges including down to 0 inches.

With continued specific reference to FIGS. 1 and 6, along the lower portion of the weep screed 10 is an elongate bottom flange section 40 extending outwardly from the back flange 12 below the upper flange 24. The bottom flange section 40 has an upper elongate member 42 extending outwardly and downwardly from the back flange 12 as shown and further includes an outer edge 44 spaced from the back flange 12. In this illustrated embodiment, the upper flange 24 extends from the back flange 12 spaced a distance S above the lower edge 20 of the back flange 12, and the bottom flange section 40 extends outwardly from a position along the back flange 12 spaced below from where the upper flange 24 extends from the back flange 12, here extending from the lower edge 20. It is appreciated that this spacing S, from where the upper flange 24 and back flange section 40 extend from the back flange 12, depending on the configuration, can range from no space (0 inches) between the two to a fairly large space, the space S being about ⅜ inches in the illustrated embodiment. The upper member 42 is preferably angled downward, forming an obtuse angle relative to the back flange 12 greater than about 91 degrees, more preferably any angle within a range of about 92 to 110 degrees, even more preferably between about 92 to 105 degrees, and more preferably about 100 degrees as used in the illustrated embodiment.

In the illustrated embodiment, the bottom flange section 40 further includes a lower elongate member 46 extending inwardly and downwardly from the upper member 42 from a location spaced outwardly from the back flange 12, preferably at an acute angle with respect to the upper member 42 so as to form a cavity 48 between the two. A bottom elongate lip 50 extending downwardly from the lower member 46 defines an edge 52, which also defines the bottom edge 54 of the weep screed 10. The edge 52 of the lip 50 is preferably coplanar with the back flange 12, (see FIG. 6) so that both can abut a wall and foundation that are coplanar. Different configurations are possible for different building configurations. The lower member 40 can further include apertures 56, see FIG. 5, to help bind the weep screed 10 to the plaster at the beginning of another veneer wall finish provided below the weep screed 10 as may be provided in some building constructions. The apertures 56 shown are about ⅛ inch diameter and about 8 inches apart from one another, although other configurations can be used.

The weep screed 10 can be made of any suitable materials, including polymers and plastics such as vinyl and PVC, and metals such as steel, and can be formed preferably as a unitary member by extrusion. In the illustrated embodiment of FIG. 1, the height H is about 4½ inches and the length L is any desired length. The back flange 12 height H1 from top 18 to lower edge 20 is about 3⅞ inches (see FIG. 2). The upper flange width W1 is about 1 inch (from the outward side of the back flange 12 to the outward side 30*a* of the front flange 30) and extends at a right angle from the back flange 12 from a distance H2 (see FIG. 1) from the top edge 18 of the back flange 12 of about 3½ inches. The front flange 30 height H3 (to the top edge 34) (see FIG. 2) is about 3/16 inches; and the lip 36 of the top edge 34 has a width W2 (see FIG. 3) about 1/16 inches extending inward. The upper member 42 of the bottom flange section 40 extends downwardly at an angle of about 100 degrees relative to the back flange 12. The upper member 42 and lower member 46 of the bottom flange section 40 are both about 1 inch in width W3 and W4 respectively. The angle between the upper member 42 and lower member 46 of the bottom flange section 40 is roughly about 25 degrees, and the lip 50 has a height H4 (see FIG. 2) of about 3/16 inches. The thickness of the various flanges and sections is about 1/16 inches. The weep screed 10 can be made in strips of predetermined lengths, and can be cut to the length needed at the construction site.

Figure 6:
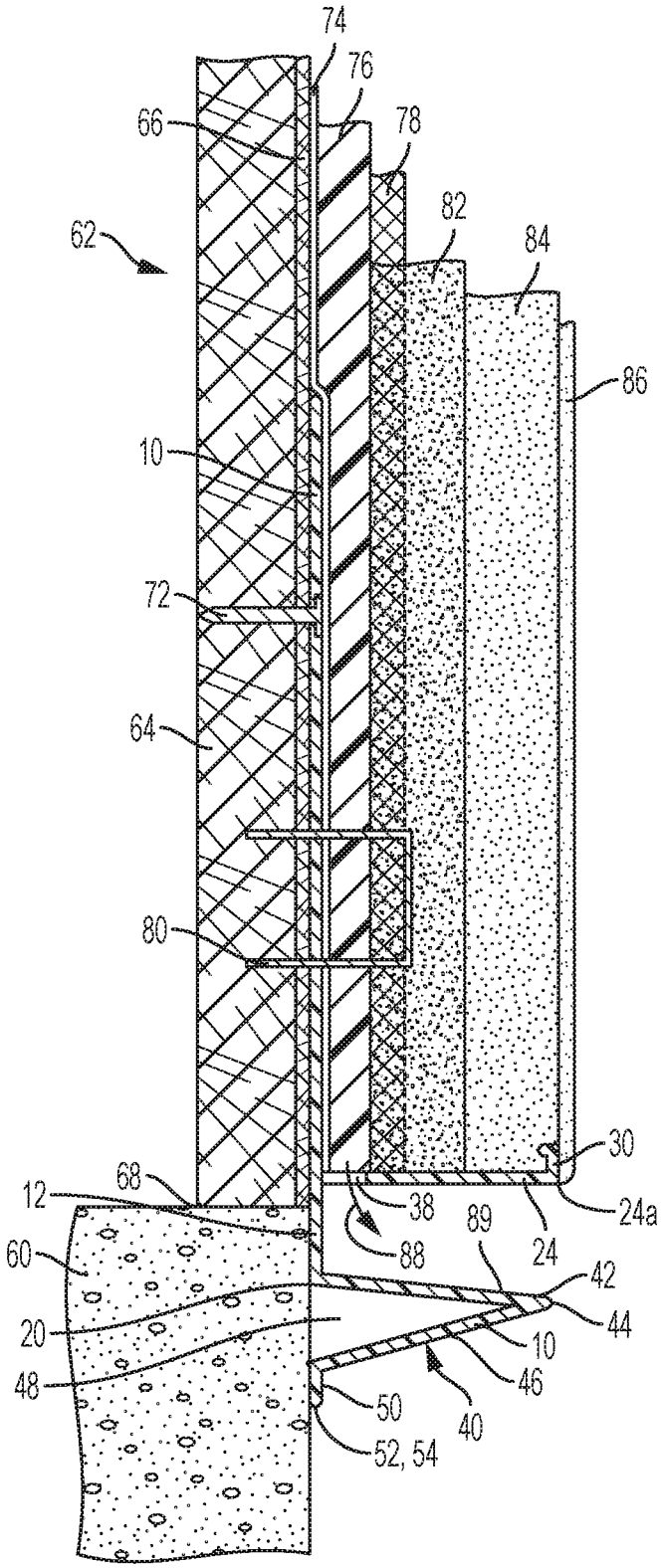
FIG. 6 is a cross sectional view of the weep screed shown in FIG. 1 used with a stucco veneer system on the side of a building.
Figure 7:
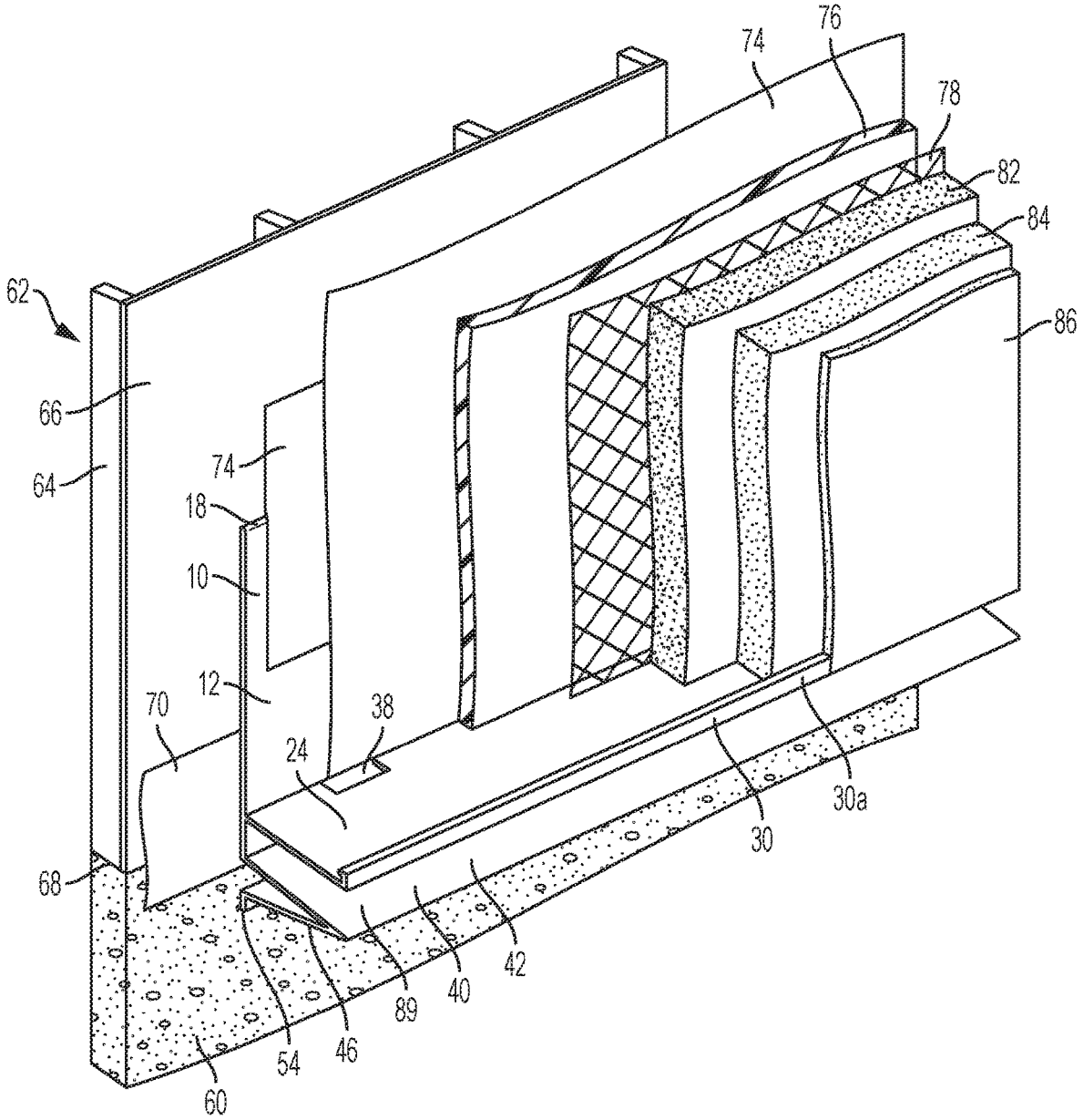
FIG. 7 is a perspective view of a stucco system on the side of a building showing the various layers partially removed and using the weep screed shown in FIG. 1.

With further reference to FIGS. 6 and 7, a preferred application of a stucco veneer external finish to a building using the weep screed 10 described above is now illustrated and described. FIG. 6 shows a cross sectional view of the completed stucco veneer system and FIG. 7 shows the various layers peeled back from one another for illustration purposes.

The building has a concrete foundation wall 60 supporting an external wall 62 having framing members 64, such as metal or wooden studs, and sheathing 66, such as plywood, attached thereto. An adhesive flashing tape 70 is applied preferably over the boundary 68 between the foundation 60 and the wall 62 to seal out water. The weep screed 10 is next applied to the outward side of the sheathing 66 over the tape 70 so as to extend over the boundary 68 as shown with the bottom flange section 40 positioned preferably below the boundary 68 to ensure that water draining from the weep screed 10 does so below the boundary 68. The weep screed 10 can be attached/secured to the sheathing 66 with any suitable attachment means such as nails 72 through the weep screed 10 into the sheathing 66 and/or studs 64 as known in the art. An adhesive sealing tape 74 is applied preferably over the nails 72 and extends over the top edge 18 of the weep screed 10 as shown to prevent water from passing through the holes created in the weep screed by the nails 72.

Next, at least one layer of a weather barrier 74, such as Tyvek® fabric, is secured to the outward side of the building wall and extends downward onto the outward face of the back flange 12, terminating at the upper flange 24. The weather barrier is typically about 1/16 inch thick.

Secured to the building wall on the outward side of the weather barrier 74 and terminating at the upper flange 24 is a drainage mat 76, such as Driwall® Rainscreen, a porous material through which water can pass. In the illustrated embodiment, the drainage mat is about ¼ inches thick. The weep screed 10 of the illustrated embodiment is configured for use with a drainage mat of about ¼ inches thick, having an upper flange width W1 of about 1 inch. Where thinner or thicker drainage mats are used, it may be preferable to use a weep screed configured accordingly, e.g., upper flange width W1 ranges between about ⅝ inch to 1¼ inch. For example, for drainage mats 76 greater than ¼ inch up to about 10 mm, which is just over ⅜ inch, a weep screed having a upper flange width W1 of about 1¼ inches may be preferable.

Next, secured to the building wall 62 on the outward of the drainage mat 76 and terminating at the upper flange 24 is a layer of mesh material 78 capable of supporting the plaster in place and which stabilizes the first coat of wet plaster. Such mesh materials 78 can include metal lath and metal wire lath and any other suitable materials for such use as known in the art. The mesh material 78 is secured in place by any suitable means, such as staples 80 which pass into the sheathing 66 as shown (FIG. 6), and which also secures in place the weather barrier 74 and drainage mat 76. In the illustrated embodiment, the mesh material 78 is formed of metal lath about ⅛ inch thick.

A first layer of plaster 82, called a scratch coat, next is applied onto the mesh material 78, and embedded into the mesh material 78 as shown, forming a layer of about ⅜ inches thick. The first layer terminates at the upper flange 24. This is followed by a second coat of plaster 84 of about ⅜ inches thick called a brown coat. A thin final finish coat of stucco plaster 86 of about ⅛ inches is applied onto the second coat 84 and terminates preferably over the outer face 30*a* of the front flange 30, incorporating the front flange 30 to provide a nice looking finish, although the outer face 30*a* can be left exposed if desired.

As seen in FIG. 6, the apertures 38 are located directly below the drainage mat 76. Any water and moisture that penetrate the plaster can drain or vent down through the drainage mat 76 and out from the upper flange 24 through the apertures 38, as illustrated by arrow 88, onto the outer surface 89 of the upper member 42 of the bottom flange section 40. Once on the outer surface 89, the water is directed away from the building and away from the foundation 60 or any lower veneer finishes. This is contrary to prior art weep screeds in which the water may be maintained underneath the various layers, including the plaster layers, or flow outwardly along the bottom edge of the plaster to drain over an outer edge of the weep screed. Thus, the weep screed 10 of the present invention allows the water to drain from behind the plaster layers, avoiding the cracking and damage problems caused by prior art weep screeds. As another advantage, ensuring that the apertures 38 are directly below the drainage mat 76 and not blocked by some of the other veneer system materials allows airflow into and venting of the drainage mat 76. This helps to keep the drainage mat 76 and space behind the veneer finish dry.

Figure 8:
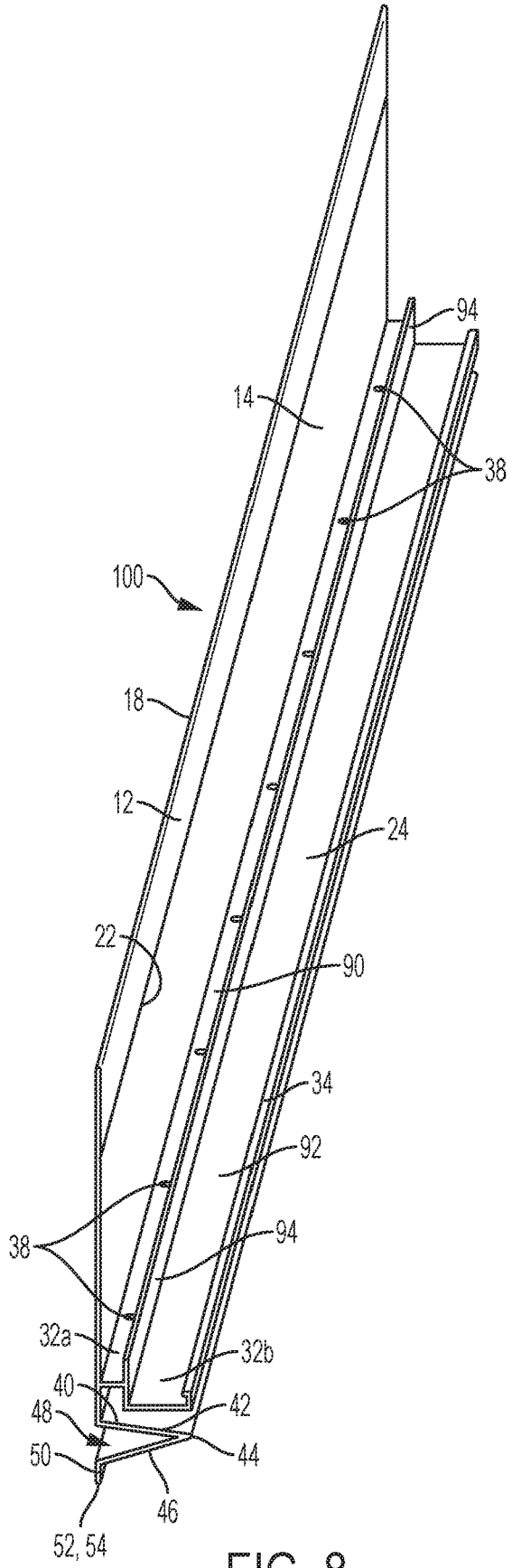
FIG. 8 is a perspective view of a second embodiment of a weep screed in accordance with the present invention.
Figure 9:
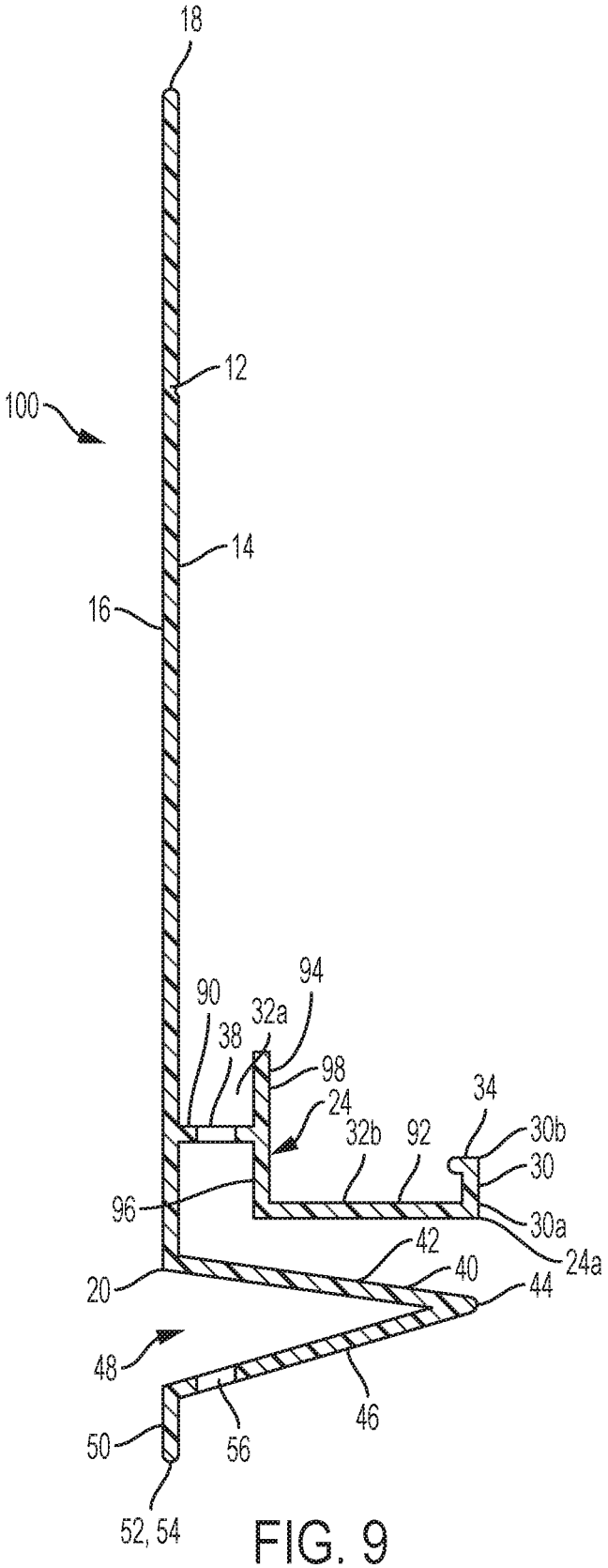
FIG. 9 is a cross sectional view of the weep screed shown in FIG. 8.

A second embodiment of the present invention is now described with reference to FIGS. 8 and 9. The weep screed 100 is similar to the weep screed 10 described above, and similar elements are designated with the same reference numbers. The main difference here is the upper flange configuration that will be described in more detail below.

Similar to the above described weep screed, the weep screed 100 includes an elongate substantially planar vertical back flange 12 having an outward facing side 14, an opposite inward facing side 16, and a top edge 18, which defines the top edge of the weep screed 100. The back flange further has a lower edge 20 and a scored nail line 22.

Along the lower portion of the weep screed 100 is the elongate bottom flange section 40 extending outwardly from the back flange 12 below the upper flange 24. The bottom flange section 40 includes an upper elongate member 42 extending outwardly and downwardly from the back flange 12 as shown and further includes an outer edge 44 spaced from the back flange 12 and the upper flange 24. The upper member 42 is preferably angled downward, forming an obtuse angle relative to the back flange 12 as described above with reference to the weep screed 10. The bottom flange section 40 further includes the lower elongate member 46 extending inwardly and downwardly from the upper member 42 from a location spaced outwardly from the back flange 12. The lower elongate member 46 extends downwardly preferably at an acute angle with respect to the upper member 42, forming a cavity 48 between the two with a distance of about ⅜ inches between the two along the inward side 16 of the weep screed. A bottom elongate lip 50 extending downwardly from the lower member 46 defines an edge 52, which also defines the bottom edge 54 of the weep screed 100. Again, the edge 52 of the lip 50 is preferably coplanar with the back flange 12 so that both can abut a wall 62 and foundation 60 that are coplanar. The lower member 46 also includes openings 56 in the lower member 46 for attaching to a stucco veneer below.

Returning to the upper flange 24, here, the upper flange 24 includes an inner flange section 90 and an outer flange section 92 separated from one another by a divider wall 94. The inner flange section 90 extends outwardly from the outward side 14 of the back flange 12 at a substantially right angle thereto and includes a plurality of apertures 38. The outer flange section 92 extends outwardly from the divider wall 94 at a substantially right angle relative to the back flange 12. An elongate front flange 30 extends upwardly from the outer flange section 92 at a substantially right angle thereto spaced from the back flange, and here extending from the edge 24*a* forming a sideways J-like structure as shown. The front flange 30 defines a substantially flat and vertical outward facing side 30*a* and further has an upper edge 30*b*, which includes a lip 34 extending a short distance inwardly as shown.

In this illustrated embodiment, the inner and outer flange sections 90, 92 are at different heights relative to one another as shown, here the outer flange section 92 being at a lower elevation than the inner flange section 90. The divider wall 94 has a lower section 96 extending downwardly from the inner flange section 90 from which the outer flange section 92 extends. The divider wall 94 further includes an upper extending section 98 extending above the inner and outer flange sections 90, 92. It is seen that the upper flange 24 forms two channels 32*a*, 32*b* between the back flange 12 and front flange 30, here separated by the divider wall 94.

The weep screed 100 is used similarly with veneer systems as discussed above with reference to FIGS. 6 and 7, the main difference being that the weather barrier 74 and drainage mat 76 terminate in the channel 32*a* and the mesh 78 and plaster/stucco coats 82, 84, 88 terminate in the channel 32*b*. This provides a separate channel 32*a* which collects and drains the water through apertures 38, keeping the water in the channel 32*a* away from the terminal ends of the plaster coats 82, 84, 88. As an example where the finish is a veneer stone, the weather barrier 74 and drainage mat 76 terminate in the channel 32*a*, and the matrix 78, scratch coat 82 and stone veneer layer terminate in the channel 32*b*. Similarly, as with the weep screed 10 discussed above, the widths of the channels 32*a*, 32*b* can be chosen for the particular use. For example, channel 32 would have a preferred width of ¼ inch for use with a drainage mat 76 of ¼ inch. For a thicker drainage mat 76, a wider channel 32*a* is preferred as discussed above. Likewise, the thickness of the channel 32*b* can be chosen for the particular use, i.e., thickness of the veneers terminating therein, e.g. brick versus stone versus stucco. As an example, preferable widths for channel 32*b* can range from ½ inch (e.g. stone veneer) to ⅞ inch.

Figure 10:
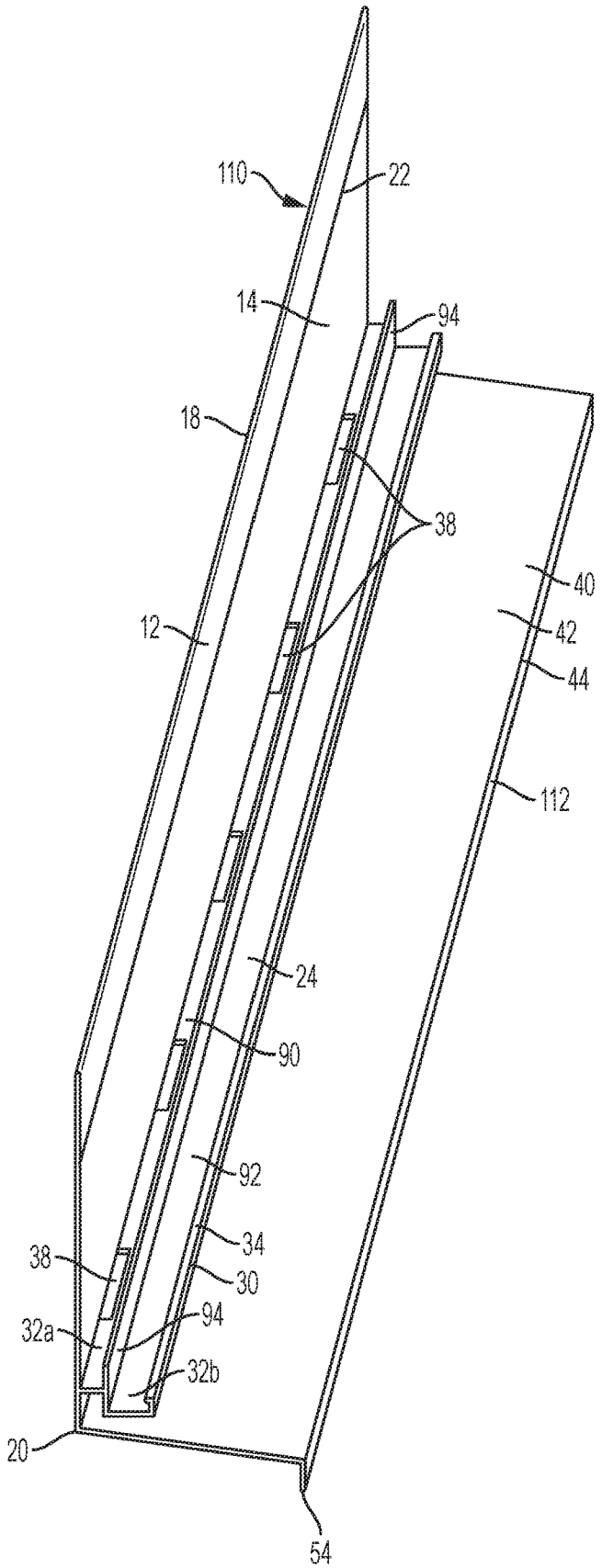
FIG. 10 is a perspective view of third embodiment of a weep screed in accordance with the present invention.
Figure 11:
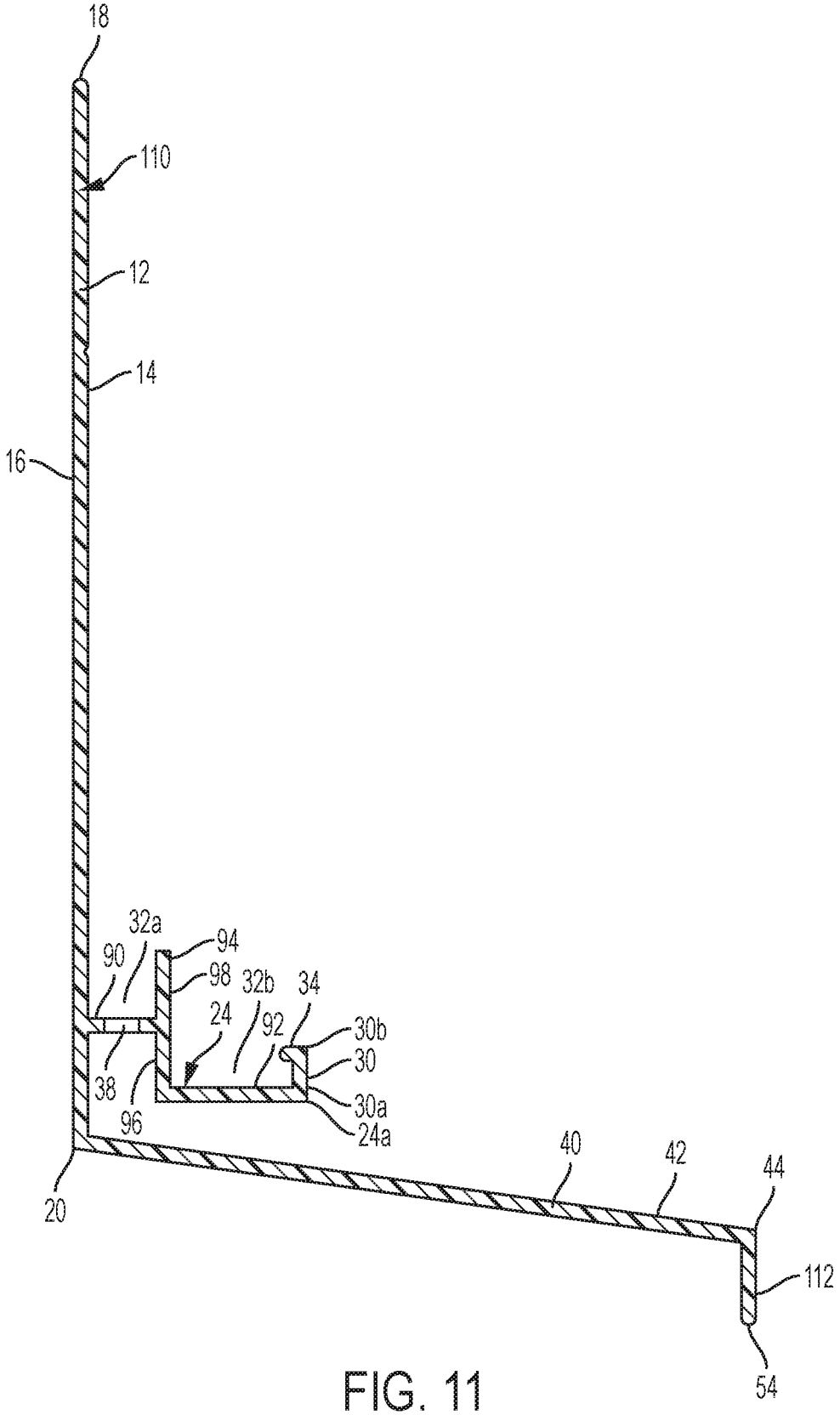
FIG. 11 is a cross sectional view of the weep screed shown in FIG. 10.

A third embodiment of the present invention is now described with reference to FIGS. 10 and 11. A weep screed 110 is illustrated similar to the weep screed 100 described above, and similar elements are designated with the same reference numbers. The main difference here is the elongate bottom flange section 40 extending outwardly from the back flange 12 below the upper flange 24. The bottom flange section 40 includes the upper elongate member 42 extending outwardly and downwardly from the back flange 12 as shown and further includes an outer edge 44 spaced from the back flange 12. The upper member 42 is preferably angled downward, forming an obtuse angle relative to the back flange 12 as described above with reference to the weep screed 10. However, unlike the weep screeds discussed above, the upper member 42 extends outwardly beyond the upper flange 24 and does not include a lower elongate member 46, instead ending with a downwardly extending lip 112 leading to the weep screed bottom edge 54. This configuration is preferred where the foundation 60 extends outwardly beyond the wall 62, see FIGS. 6 and 7, requiring the additional length for upper member 42 to direct water from the apertures 38 away from the foundation 60. This embodiment also uses rectangular apertures 38 as shown and described for the weep screed 10 above.

The previous description is provided to enable a person skilled in the art to make and use the present subject matter. Various modifications to these aspects will be readily apparent to those skilled in the art, and the generic principles defined herein may be applied to other aspects without departing from the spirit or scope of the subject matter. For example, one or more elements in the different embodiments can be rearranged and/or combined, or additional elements may be added. Thus, the present subject matter is not intended to be limited to the aspects shown herein but is to be accorded the widest scope consistent with the principles and novel features disclosed herein.

I claim:

1. A weep screed, comprising:

an elongate substantially planar back flange having an outward side and an opposite inward side, and further having a top edge and a lower edge;

an elongate upper flange extending outwardly from said outward side of said back flange spaced from said top edge and having an outer edge;

an elongate front flange extending upwardly from said upper flange spaced from said back flange, said front flange having an upper edge and a lip extending a short distance inwardly from the upper edge, and said upper flange forming at least one channel between said front flange and said back flange;

a plurality of rectangular apertures in said upper flange through which water can drain, said plurality of rectangular apertures being spaced from one another and disposed adjacent said back flange; and an elongate bottom flange section extending outwardly from said back flange below said upper flange, said bottom flange section having an upper member extending outwardly and downwardly from said back flange and further includes an outer edge spaced from said back flange.

2. A weep screed in accordance with claim 1 wherein said upper flange extends from said back flange spaced from said lower edge of said back flange, and said bottom flange section extends outwardly from a position along said back flange spaced from where said upper flange extends from said back flange.

3. A weep screed in accordance with claim 2 wherein said bottom flange extends from said back flange at said lower edge of said back flange.

4. A weep screed in accordance with claim 1 wherein said bottom flange section further includes a lower member extending inwardly and downwardly from said upper member from a location spaced outwardly from said back flange and at an acute angle with respect to the upper member.

5. A weep screed in accordance with claim 4 wherein said bottom flange section extends outwardly from a position along said back flange below and spaced from where said upper flange extends from said back flange.

6. A weep screed in accordance with claim 4 wherein said upper member of said bottom flange section extends downwardly at an angle greater than 91 degrees with respect to said back flange.

7. A weep screed in accordance with claim 4 wherein said upper member of said bottom flange section extends downwardly at an angle within the range of about 92 to about 120 degrees with respect to said back flange.

8. A weep screed in accordance with claim 4 wherein said lower member extends from said upper member to a bottom edge of said weep screed spaced from where said upper member extends from said back flange so as to create a cavity between said upper and lower members of said bottom flange section.

9. A weep screed in accordance with claim 1 wherein said apertures are elongate extending longitudinally along said upper flange.

10. A weep screed in accordance with claim 9 wherein said apertures are rectangular in shape extending longitudinally along said upper flange.

11. A weep screed in accordance with claim 1 wherein said plurality of apertures are disposed immediately adjacent said back flange.

12. A weep screed in accordance with claim 1 wherein said plurality of apertures are disposed no more than about ¼ inch from said back flange.

13. A weep screed, comprising:

an elongate substantially planar back flange having an outward side and an opposite inward side, and further having a top edge and a lower edge;

an elongate upper flange extending outwardly from said outward side of said back flange spaced from said top edge and having an outer edge;

a plurality of rectangular apertures in said upper flange through which water can drain, said plurality of rectangular apertures being spaced from one another and disposed adjacent said back flange; and an elongate bottom flange section extending outwardly from said back flange below said upper flange, said bottom flange section having an upper member extending outwardly and downwardly from said back flange and further includes an outer edge spaced from said back flange.

14. A weep screed in accordance with claim 13 wherein said bottom flange section further includes a lower member extending inwardly and downwardly from said upper member from a location spaced outwardly from said back flange and at an acute angle with respect to the upper member.

15. A weep screed in accordance with claim 13 wherein said plurality of apertures are disposed no more than about ¼ inch from said back flange.

16. A weep screed in accordance with claim 15 further comprising an elongate front flange extending upwardly from said upper flange spaced from said back flange, said front flange having an upper edge, and said upper flange forming at least one channel between said front flange and said back flange.

17. A weep screed in accordance with claim 13 wherein said plurality of apertures are disposed immediately adjacent said back flange.

18. A weep screed in accordance with claim 13 wherein said plurality of apertures are disposed no more than about 3/16 inch from said back flange.

* * * * *